US007334570B2

(12) United States Patent
Klyza

(10) Patent No.: US 7,334,570 B2
(45) Date of Patent: Feb. 26, 2008

(54) COMMON RAIL FUEL INJECTION SYSTEM WITH ACCUMULATOR INJECTORS

(75) Inventor: Clark A. Klyza, San Diego, CA (US)

(73) Assignee: Achates Power, Inc., San Diego, CA (US)

( * ) Notice: Subject to any disclaimer, the term of this patent is extended or adjusted under 35 U.S.C. 154(b) by 211 days.

(21) Appl. No.: 11/097,909

(22) Filed: Apr. 1, 2005

(65) Prior Publication Data

US 2006/0219220 A1 Oct. 5, 2006

(51) Int. Cl.
*F02M 37/04* (2006.01)
*F02M 59/46* (2006.01)
*F02M 41/16* (2006.01)

(52) U.S. Cl. ..... 123/467; 239/96; 123/458

(58) Field of Classification Search ..... 123/456, 123/458, 467, 447, 446; 239/88, 96
See application file for complete search history.

(56) References Cited

U.S. PATENT DOCUMENTS

| | | | | |
|---|---|---|---|---|
| 3,827,409 | A * | 8/1974 | O'Neill | 123/458 |
| 4,080,942 | A * | 3/1978 | Vincent et al. | 123/447 |
| 4,513,719 | A | 4/1985 | Edo et al. | 123/447 |
| 4,605,166 | A | 8/1986 | Kelly | 239/96 |
| 4,612,893 | A * | 9/1986 | Ishibashi et al. | 123/447 |
| RE33,270 | E | 7/1990 | Beck et al. | 123/447 |
| 5,012,786 | A | 5/1991 | Voss | 123/467 |
| 5,392,745 | A | 2/1995 | Beck | 123/295 |
| 5,450,829 | A | 9/1995 | Beck | 123/435 |
| 5,558,063 | A * | 9/1996 | Minagawa et al. | 123/457 |
| 5,727,515 | A * | 3/1998 | Biester | 123/198 D |
| 5,727,525 | A * | 3/1998 | Tsuzuki | 123/447 |
| 5,794,586 | A * | 8/1998 | Oda et al. | 123/305 |
| 5,918,578 | A * | 7/1999 | Oda | 123/456 |
| 6,027,037 | A * | 2/2000 | Murakami et al. | 239/88 |
| 6,073,597 | A | 6/2000 | Harata et al. | 123/179 |
| 6,119,655 | A * | 9/2000 | Heinitz et al. | 123/447 |
| 6,273,076 | B1 | 8/2001 | Beck et al. | 123/679 |
| 6,311,674 | B1 | 11/2001 | Igashira et al. | 123/458 |
| 6,446,609 | B2 | 9/2002 | Mizuno et al. | 123/479 |
| 6,491,017 | B1 * | 12/2002 | Mahr et al. | 123/299 |
| 6,536,416 | B1 * | 3/2003 | Mahr et al. | 123/506 |
| 6,598,584 | B2 | 7/2003 | Beck et al. | 123/299 |
| 6,691,649 | B2 | 2/2004 | Zauner et al. | 123/73 |

(Continued)

FOREIGN PATENT DOCUMENTS

DE 712 518 10/1941

(Continued)

OTHER PUBLICATIONS

Diesel-Engine Management, 3rd Editiion, completely revised and extended, Robert Bosch GmbH, 2004, pp. 248-249.

(Continued)

*Primary Examiner*—Thomas Moulis
(74) *Attorney, Agent, or Firm*—Incaplaw; Terrance A. Meador

(57) ABSTRACT

A fuel injection system for an internal combustion engine includes a common rail, a plurality of accumulator injectors, and at least one accumulator controller separate from the accumulator injectors and connected to the common rail. Each accumulator controller includes a solenoid-controlled valve to control the fuel injection operations of one or more accumulator injectors.

20 Claims, 3 Drawing Sheets

U.S. PATENT DOCUMENTS

| | | | | |
|---|---|---|---|---|
| 6,718,947 | B1 * | 4/2004 | Mahr et al. | 123/447 |
| 6,776,140 | B2 * | 8/2004 | Maier et al. | 123/456 |
| 7,047,941 | B2 * | 5/2006 | Draper et al. | 123/447 |
| 7,143,746 | B2 * | 12/2006 | Knight et al. | 123/447 |
| 2003/0094158 | A1 | 5/2003 | Maier et al. | 123/447 |
| 2005/0274332 | A1 | 12/2005 | Lemke et al. | 123/41.35 |

FOREIGN PATENT DOCUMENTS

| | | |
|---|---|---|
| DE | 712518 | 10/1941 |
| EP | 0699835 | 3/1996 |
| WO | WO 2004/005699 | 1/2004 |
| WO | WO 2005/124124 A1 | 12/2005 |

OTHER PUBLICATIONS

PCT International Search Report and Written Opinion for PCT/US2006/012353.

Annex to Form PCT/USA/206, mailed Jul. 3, 2006, with respect to a partial international search report in PCT/US2006/021353.

Patent Abstracts of Japan with respect to JP Pub. No. 60-011674, Jan. 21, 1985 for "Nozzle and Nozzle Holder Built Up Structure."

* cited by examiner

COMMON RAIL FUEL INJECTION SYSTEM WITH ACCUMULATOR INJECTORS

CROSS REFERENCE TO RELATED APPLICATIONS

The following copending applications, all commonly assigned to the assignee of this application, contain subject matter related to the subject matter of this application:

U.S. patent application Ser. No. 10/865,707, filed Jun. 10, 2004 for "Two Cycle, Opposed Piston Internal Combustion Engine", published as US2005/0274332 A1 on Dec. 29, 2005;

PCT application US05/020553, filed Jun. 10, 2005 for "Improved Two Cycle, Opposed Piston Internal Combustion Engine", published as WO2005/124124 A1 on Dec. 15, 2005;

U.S. patent application Ser. No. 11/095,250, filed Mar. 31, 2005 for "Opposed Piston, Homogeneous Charge, Pilot Ignition Engine";

PCT application US06/011886, filed Mar. 30, 2006 for "Opposed Piston, Homogeneous Charge, Pilot Ignition Engine";

PCT application US06/012353, filed Mar. 30, 2006 "Common Rail Fuel Injection System With Accumulator Injectors"; and U.S. patent application Ser. No. 11/378,959, filed Mar. 17, 2006 for "Opposed Piston Engine".

BACKGROUND

A fuel injection system for an internal combustion engine includes a common rail and accumulator injectors.

A diesel engine is a compression ignition engine. That is to say, the engine includes a cylinder in which a piston compresses air to raise its temperature, and fuel is injected into the cylinder where it mixes with the compressed, heated air, ignites and burns, releasing energy to drive the engine. A fuel injection system operates cooperatively with the engine to pressurize the fuel and to inject it into the cylinder as a mist or cloud of small droplets. An accumulator injector as may be used in such a fuel injection system receives pressurized fuel and includes a chamber controlled by a two-way valve in which the pressurized fuel accumulates until released by a needle valve through a nozzle. The needle valve is controlled by opposing forces exerted by the pressurized fuel. At a particular time during engine operation, one of the forces is relieved when the fuel exerting it is diverted ("spilled") through a spill port, permitting the needle valve to open, whereupon the injector injects a charge of pressurized fuel into an engine cylinder.

The pressurized fuel accumulated in the chamber of the accumulator injector is injected in a very short pulse wherein the rate of injection is initially very high and falls rapidly to the end of injection. A particularly desirable feature of the pulse of fuel when injected through a nozzle is formation of an expanding cloud of fuel droplets that burn quickly and cleanly. In this regard, in conventional fuel injection systems, the injection begins when the pressure in the injector is sufficiently high enough to cause an injection valve to open. Since the injector is usually directly connected to an injector pump, the pressure in the injector increases during the injection cycle until cutoff occurs. The pressure rise causes the velocity of the injected stream of fuel to increase during the injection period with the result that the earlier portions of the injected stream, that have been slowed by the high density of compressed combustion air, are overtaken by the higher velocity of the later-injected stream, and agglomeration of the fuel droplets occurs. Such large droplets are then poorly evaporated and incompletely burned, resulting in the formation of soot and CO. In an accumulator injector, the pressure profile is reversed, with the later portions of the injected fuel stream having a lower velocity than the initial portions. The result is a desirable expanding cloud of fuel droplets characterized by absence of agglomeration.

An accumulator injector is typically provided as an integral electromechanical unit that includes an accumulator volume, a two-way valve, a needle valve assembly, a nozzle, a spill port and a solenoid mechanism to control the operation of the injector by actuating spilling through the spill port. Such a construction results in a relatively elongate injector assembly that complicates engine layout. Furthermore, if engine design requires more than one injector per cylinder, parametric variations and uneven heating may require the addition of control circuitry to synchronize solenoid responses of the multiple injectors.

SUMMARY

A fuel injection system for an internal combustion engine includes a common rail and a plurality of accumulator injectors. The system further includes at least one accumulator controller separate from the accumulator injectors and connected to the common rail. Each accumulator controller includes a solenoid-controlled valve to control the fuel injection operations of one or more accumulator injectors.

BRIEF DESCRIPTION OF THE DRAWINGS

The below-described drawings are meant to illustrate principles and examples discussed in the following detailed description. They are not necessarily to scale.

DETAILED DESCRIPTION

Common Rail Fuel Injection System

Figure 1:
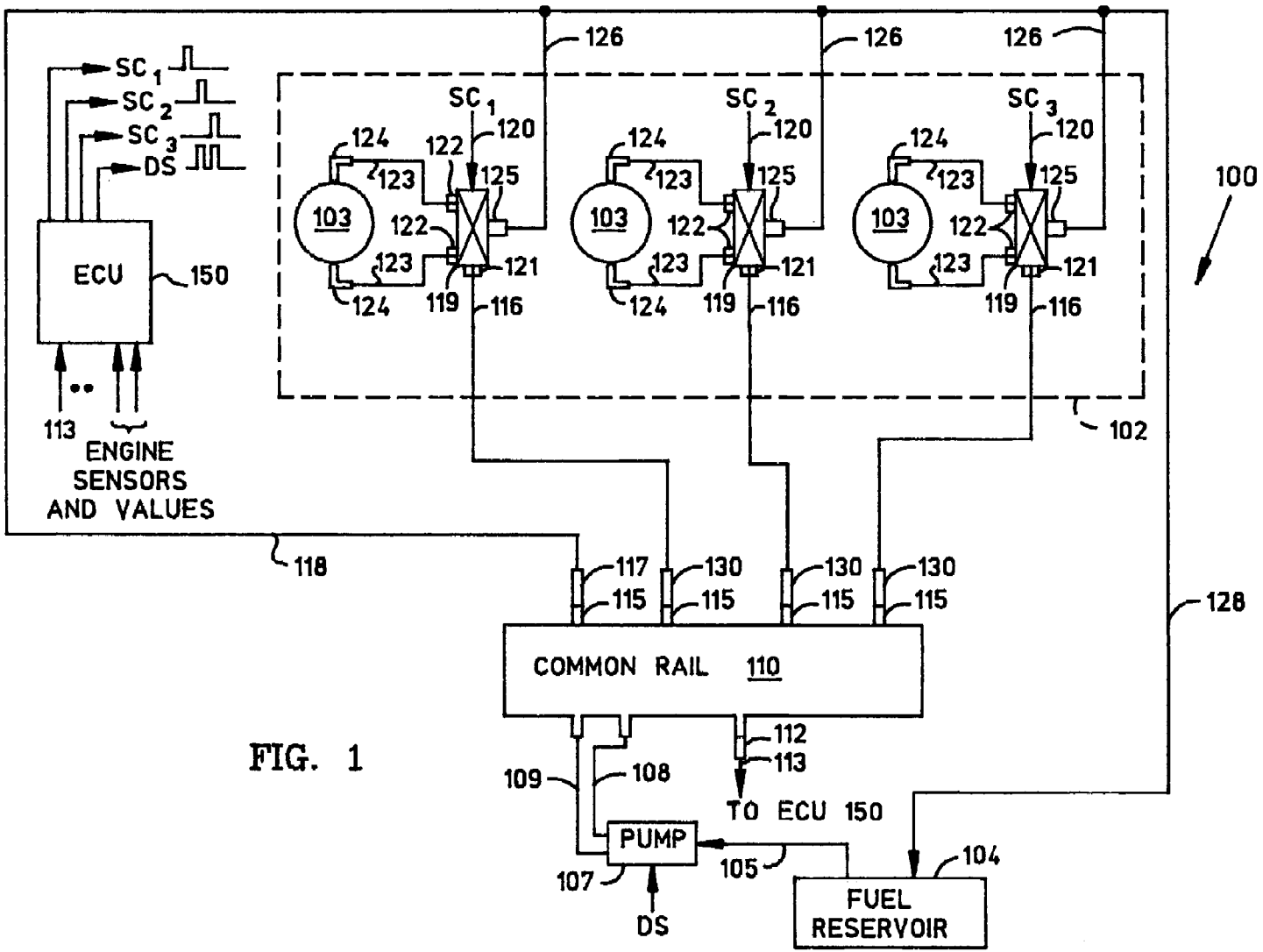
FIG. 1 illustrates the utilization of a common rail fuel injection system with accumulator injectors in an internal combustion engine.

A common rail fuel injection system 100 with accumulator injectors is illustrated in the schematic drawing of FIG. 1. The system 100 is intended for use in a compression-ignition engine an example of which is the opposed-piston engine 102 shown in FIG. 1. Such an opposed-piston engine is described and illustrated in U.S. patent application Ser. No. 10/865,707, filed Jun. 10, 2004. Without limiting the principles set forth in this specification, the engine 102 may have three cylinders 103.

In the common rail fuel injection system 100 a fuel reservoir 104 is connected by a low pressure fuel line 105 to a high pressure pump 107. The pump 107 may be constituted of an electronically-controlled reciprocating pump (such as the Denso DP3 high pressure common rail pump) with dual outputs connected by high pressure fuel lines 108 and 109 to a common rail 110. The common rail 110 may, for example, comprise a Denso model 0371 03F 0392. A pressure transducer 112 (such as a Denso 6140) is received in one port of the common rail 110 and connected by an electrical signal lead 113 to an engine control unit (ECU) that is described below. The common rail 110 has a plurality of output ports 115. High pressure fuel lines 116 are connected to a number of the output ports 115; and a safety relief valve 117 received in one of the output ports 115 is connected to a low pressure fuel line 118. The common rail fuel injection system 100 further includes one or more accumulator controllers 119. For example, three accumulator controllers 119 are provided for the engine 102, one for each cylinder 103. Each accumulator controller has a signal input 120, an input port 121 connected to a respective high pressure fuel line 116, output ports 122 to which high pressure fuel lines 123 are connected, and a return port 125. The signal input 120 receives control signals from the ECU. Each high pressure fuel line 123 connects an output port 122 to an accumulator injector 124 mounted for injecting fuel into a cylinder 103. The return port 125 is connected to a low pressure fuel line 126. The low pressure fuel lines 118 and 126 are connected to a return line 128.

Figure 2:
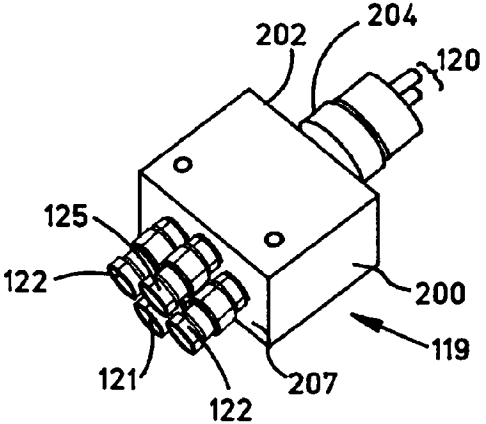
FIG. 2 is a perspective drawing of an accumulator controller.

As is evident from inspection of FIG. 1, each accumulator controller 119 is disposed to serve a respective cylinder 103; further, each accumulator controller 119 controls the injection operations of at least one accumulator injector 124. In the example of FIGS. 1 and 2, each accumulator controller 119 controls two accumulator injectors 124, although this number is meant for illustration only and is not intended to limit the principles set forth in this specification. Moreover, each accumulator controller 119 is disposed and adapted for controlling one or more accumulator injectors mounted to or serving a respective one of the cylinders of a compression ignition engine.

The engine 102 includes an engine control unit (ECU) 150, an electronic appliance with memory, programming, and processing circuitry. The ECU 150 receives inputs from engine sensors and value generators, and subjects the inputs to engine control functions by way of various actuators. In addition to other engine systems, the ECU 150 controls the common rail fuel injection system 100, employing signals produced by the pressure transducer 112 and other sensors (not shown) and particular algorithms to monitor and control the operations of the pump 107 in order to maintain a predetermined fuel pressure in the common rail 110 and the high-pressure fuel lines 116. In addition, the ECU 150 processes other signals received from other sensors and value generators (not shown) with particular algorithms to control the injection of fuel by the common rail fuel injection system 100 into the cylinders of a compression ignition engine in synchronism with the operation of the engine.

Figure 3B:
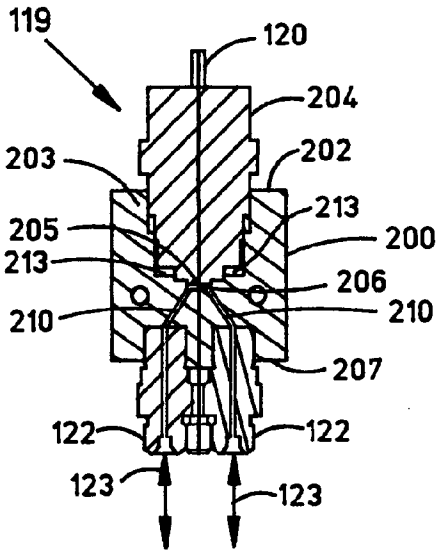
FIGS. 3A and 3B are respective side sectional views of the accumulator controller of FIG. 2.
Figure 3A:
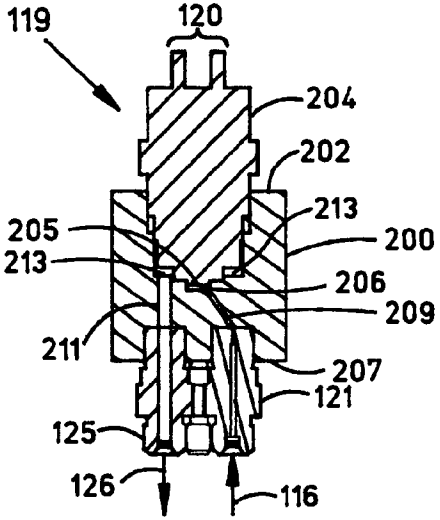

An accumulator controller 119 is illustrated in FIGS. 2, 3A, and 3B. The accumulator controller includes a substantially cubic manifold 200 made from medium carbon steel. The manifold is machined at one end 202 to provide a threaded internal recess 203 that receives the threaded retaining nut of a solenoid-controlled valve 204 (such as part number 1 467 441 015 available from Bosch). An accumulation volume 206 is defined between the end 205 of the valve 204 and the floor of the threaded internal recess. The inlet port 121 (constituted of a high-pressure connector) is mounted in a recess provided through a second end 207 of the manifold 200; a bore 209 puts the inlet port 121 in fluid communication with the accumulation volume 206. The outlet ports 122 (each constituted of a high-pressure connector) are mounted in respective recesses provided through the second end 207 of the manifold 200; bores 210 put the outlet ports 122 in fluid communication with the accumulation volume 206. The return port 125 (also constituted of a high-pressure connector) is mounted in a recess provided through the second end 207 of the manifold 200; a bore 211 puts the return port 125 in fluid communication with a return volume 213. Provision is made in mounting the solenoid-controlled valve 204 to seal the accumulation volume 206 from the return volume 213.

The solenoid-controlled valve 204 is a conventional two-way device with a plunger-gated internal bore (not shown) that connects the accumulation volume 206 with the return volume 213. The operation of the solenoid-controlled valve 204 is controlled by a signal SC produced by the ECU and provided on the signal input 120. The signal SC defines at least two states for the valve 204: OPEN and CLOSED. In the OPEN state, the solenoid is de-energized, causing the valve 204 to open the internal bore, putting the accumulation volume 206 in communication with the return volume 213. When in the CLOSED state, the solenoid is energized, causing the valve 204 to close the internal bore, disconnecting the accumulation volume 206 from the return volume 213.

Pressurized fuel is fed into the accumulation volume 206 through the inlet port 121. As long as the valve 204 is in the CLOSED state, the pressurized fuel is forced through the accumulation volume 206 to the outlet ports 122. When the valve 204 is in the OPEN state, the accumulation volume 206 is in fluid communication with the return volume 213, and, through the return port 125, the low pressure line 126, and the return line 128, to the fuel reservoir 104. From another aspect, when the valve 204 is in the CLOSED state, fuel pressure in each of the fuel lines 123 may be maintained at a first pressure (the pressure in the common rail 110), and when the valve 204 is in the OPEN state fuel pressure may be maintained in each of the fuel lines 123 at a second pressure (the return pressure) lower than the first pressure.

Figure 4:
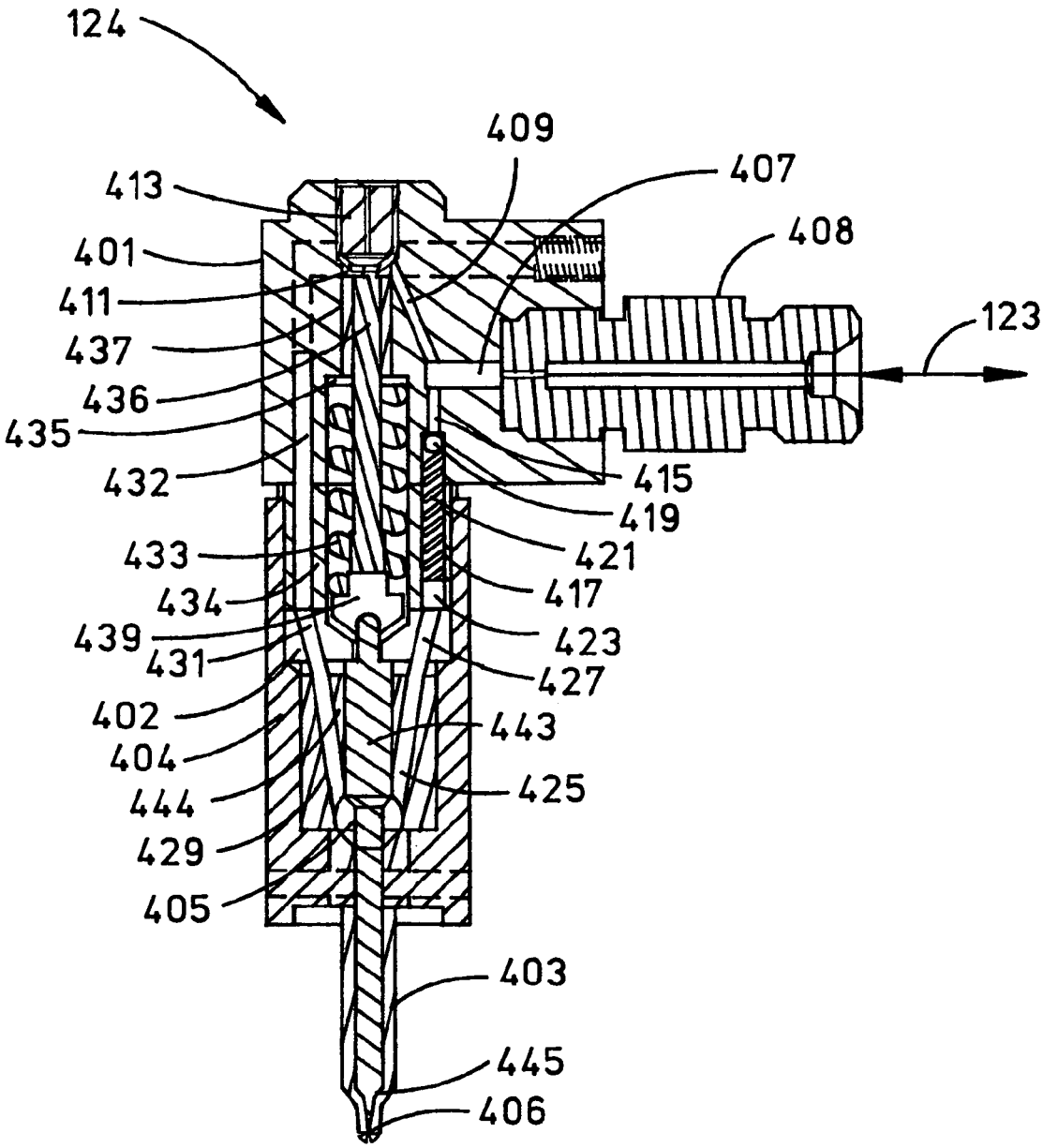
FIG. 4 is a side elevation section drawing of an accumulator injector.

An accumulator injector 124 is illustrated in FIG. 4. The accumulator injector 124 is a hydraulically-controlled element and responds to a hydraulic signal produced by an accumulator controller 119 as it transitions between OPEN and CLOSED states. A conventional accumulator injector is provided in a structure that physically weds the injector mechanism with a multi-way solenoid-controlled valve. However, as is evident from FIGS. 1, 2, and 4, the accumulator injector 124 is physically separate from a solenoid-controlled valve. Instead, the solenoid-controlled valve 204 that controls the operations of the accumulator injector 124 is placed in an accumulator controller 119. The physical separation of the accumulator injector 124 from a solenoid-controlled valve provides for a smaller, shorter element than a conventional accumulator injector.

The accumulator injector 124 illustrated in FIG. 4 includes an elongated body constituted of an upper body portion 401, an intermediate plate 402, and an elongate nozzle body 403. A centrally-bored nut 404 threaded to the upper body portion 401 holds the elements 401, 402, and 403 together as illustrated. A stepped axial bore 405 extends from the upper body portion 401, through the intermediate plate 402, through and to the tip of the nozzle body 403. One or more nozzle orifices 406 open through the tip of the nozzle body into the axial bore 405. An inlet/return bore 407 in the upper body portion 401 is accessed through the central bore of a high pressure inlet/return connector 408 mounted radially to the upper body portion 401. One end of a high-pressure fuel line 123 is received on the connector 408; the other end of the fuel line 123 is received on an outlet port connector of an accumulator controller 119 (not shown in this figure). The inlet/return bore 407 communicates through a diagonal inlet/return passage 409 with a hold pin hydraulic volume 411 defined in a portion of the axial bore 405 in the upper body portion 401, beneath a plug 413. A lower inlet passage 415 communicates at its upper end with the inlet/return bore 407 and, at its lower end, with a check volume 417. The check volume 417 is a tubular space containing a check ball 419, a check ball spring 421, and an annulus 423 forming a check ball spring seat. The check ball spring 421 acts between the check ball 419 and the annulus 423 to retain the check ball 419 seated against the lower end of the lower inlet passage 415. A first nozzle body passage 425 communicates with the check volume 417 through a first diagonal passage 427 in the intermediate plate 402. At its lower end, the first nozzle body passage 425 opens into the axial bore 405. A second nozzle body passage 429 connects the axial bore 405 with the lower end of a second diagonal passage 431 in the intermediate plate 402. The upper end of the second diagonal passage 431 communicates with an accumulator volume 432 in the upper body portion 401. A needle spring 433 located in a needle spring cavity 434 at a central portion of the axial bore 405 is retained against a needle spring shim 435. A needle hold pin 436 extends axially through the needle spring 433. The upper end of the needle hold pin 436 is slidably retained in a hold pin bushing 437 seated in the axial bore 405. Diametrical clearance between the hold pin 436 and the hold pin bushing 437 acts to isolate the needle spring cavity 434 from fluid communication with the hold pin hydraulic volume 411. A needle spring guide 439 on the lower end of the needle hold pin 436 is located in the lower end of the needle spring cavity 434. The needle spring 433 is retained in a compressed state between the fixed shim 435 and the moveable needle spring guide 439. An elongate needle 443 is slidably disposed in a needle guide portion 444 of the nozzle body 403. Diametrical clearance between the needle 443 and the needle guide portion 444 acts to isolate the needle spring cavity 434 from fluid communication with the accumulator volume 432. The top end of the needle 443 is axially aligned and in contact with the underside of the needle spring guide 439. The lower end of the needle 443 is received against a conical seat 445 in the nozzle body 403 at the tapered lower end of the axial bore 405, near the one or more orifices 406.

The compression force of the needle spring 433 urges the needle spring guide 439 and the needle 443 through the needle guide portion 444 in the direction of the lower end of the nozzle body 403 so that the end of the needle 443 is retained against the conical seat 445 and seals the one or more orifices 406. Presume that pressurized fuel fed through the high pressure fuel line 123 is forced into the inlet/return bore 407. The pressurized fuel charges the accumulator injector at the pressure of the fuel in the common rail 110. That is, pressurized fuel flows into the hold pin hydraulic volume 411 via 407, 409 and, via 407, 415 (moving the check ball 419 away from the passageway 415), into accumulator space comprising 417, 427, 425, 429, 431, 432 and the clearance space between the axial bore 405 and the needle 443. The pressure of the fuel in the hold pin hydraulic volume 411 acts through the top of the hold pin 436, against the needle 443, in the direction of the tip of the nozzle body 403. The pressurized fuel accumulated in the accumulator space below the check ball 419 acts on the effective area of the needle 443 to create an upward force in the direction of the plug 413. The upward force created by pressurized fuel acting on the effective area of the needle 443 is less than or equal to the downward force exerted on the hold pin 436 by pressurized fuel in the hold pin hydraulic volume 411. The greater downward force acts to retain the end of the needle 443 in sealing engagement against conical seat 445 in the tip of the nozzle body 403. As long as the needle is so retained, no fuel passes through the one or more orifices 406.

Now, presume that the fuel pressure acting through the high-pressure fuel line 123 is suddenly removed. Relief of the fuel pressure in the inlet/return bore 407 relieves pressure in the hold pin hydraulic volume 411 and on the check ball 419. The check ball spring 421 and the pressure of the fuel in the accumulator space force the check ball 419 into sealing engagement against the bottom of the inlet passageway 415, retaining the pressurized fuel in the accumulator space. The pressure of the fuel in the accumulator space acting on the effective area of the needle 443 creates an upward force sufficient to overcome the downward force of the needle spring 433 and the diminished downward force of the hold pin 436, thus forcing the needle 443 upwardly in the axial bore 405 in a sudden displacement away from the conical seat 445 in the tip of the nozzle body 403. This sudden upward movement of the needle 443 compresses the needle spring 433, unseals the one or more orifices 406 and allows pressurized fuel to exit the accumulator space through the one or more orifices 406. As fuel exits the accumulation space, fuel pressure in the accumulator space and the resulting upward force on the needle 443 decay such that the compression force of the needle spring 433 forces the needle 443 back into the conical seat 445 in the tip of the nozzle body 403, once again sealing off the one or more nozzle orifices 406. The reciprocating axial motion of the needle 443 allows a pulse of pressurized fuel to exit the nozzle body 403 through the one or more orifices 406 in the form of an expanding cloud of fuel droplets. The pulse has a short duration with a steeply rising forward edge and a trailing edge with a decreasing slope.

System Operation

With reference to the figures, the pump 107 supplies pressurized fuel into the internal volume of the common rail 110. For example, the pump may supply diesel fuel at a high pressure (for example, 1800 bar) measured in the common rail 110. The common rail 110 maintains a reserve of fuel at the pressure provided by the pump 107. The pressure transducer 112 senses the magnitude of the pressure of the fuel in the common rail 110. The pressure transducer 112 produces an electrical signal indicative of the magnitude of the fuel pressure; this signal is provided to the ECU 150 on the signal line 113. At the ECU 150, a magnitude of the signal produced by the pressure transducer 112 is checked against a table correlating signal magnitudes with pressure magnitudes to determine the pressure of the fuel in the common rail 110. The pressure magnitude value is compared to a first preset pressure magnitude value and a duty cycle signal DS is provided by the ECU 150 to the high pressure pump 107 to adjust the output of the pump, as required. In the event the pressure in the common rail 110 exceeds a mechanically preset pressure magnitude of the safety relief valve 117, which is always greater than the first preset pressure magnitude value, the safety relief valve 117 will open and bleed fuel from the common rail 110 to the return line 128. A mechanically-actuated flow limiter 130 may be mounted in each output port 115 supplying fuel to a high pressure line 116 and may include a mechanism for connecting to a high pressure line 116. If used, each flow limiter 130 would provide a positive shut off of fuel through an output port 115 should the high pressure line 116 or components served by the high pressure line 116 and the port 115 fail.

In preparation for injection, a pressurized high pressure fuel line 116 connected to the input port 121 of a respective accumulator controller 119 provides pressurized fuel to the controller. Initially, the ECU 150 conditions the SC signal to energize the solenoid valve 204 of the accumulator controller 119, thereby placing the valve 204 in the CLOSED condition and directing pressurized fuel through one or more high-pressure fuel lines 123 to charge one or more accumulator injectors 124. When engine operating conditions dictate injection for the cylinder served by the accumulator controller, the ECU 150 conditions the SC signal to de-energize the solenoid valve 204, thereby placing it in the OPEN condition and causing pressurized fuel to be returned from the accumulation volume 206 of the accumulator controller 119 through the return volume 213 and low pressure fuel line 126 to the fuel reservoir 104. The return of fuel through the accumulator controller 119 causes the pressure in the inlet/return bore 407 of the one or more accumulator injectors 124 to decay, which initiates injection of fuel by the one or more accumulator injectors 124 into the cylinder.

In controlling injection by the accumulator injectors 124, the ECU 150 produces a separate SC signal for each accumulator controller 119. In the example illustrated in FIG. 1, these signals are denoted, respectively, as $SC_1$, $SC_2$, and $SC_3$. Each SC signal has a pulsed shape in which the pulse magnitude and duration cause the one or more accumulator injectors 124 connected to the controller 119 receiving the signal to produce the desired injection pulse of fuel. The ECU 150 operates the accumulator controllers 119 by means of sequences of respective SC signals synchronized to the operation of the engine being fueled.

It should be noted that, the inventive principles set forth herein are not limited to the embodiments, which are meant to be illustrative only. Consequently, these principles are limited only by the following claims:

The invention claimed is:

1. A fuel injection system, comprising:

a fuel supply for supplying fuel at pressure;

at least one accumulator injector;

a fuel line connected to the accumulator injector;

an accumulator controller connected to the fuel supply and to the fuel line;

the accumulator controller having a first state for feeding fuel into the fuel line at a first pressure that charges the at least one accumulator injector and a second state for returning fuel from the fuel line at a second pressure that is lower than the first pressure and initiates injection by the at least one accumulator injector.

2. A fuel injection system, comprising:

a fuel supply for supplying fuel at pressure;

at least one pair of accumulator injector mechanisms;

a pair of fuel lines, each connected to a respective one of the accumulator injector mechanisms;

an accumulator controller connected to the fuel supply and to the pair of fuel lines;

the accumulator controller having a first state for feeding fuel into the pair of fuel lines at a first pressure that charges the at least one pair of accumulator injectors and a second state for returning fuel from the pair of fuel lines at a second pressure that is lower than the first pressure and initiates injection by the at least one pair of accumulator injectors.

3. The fuel injection system of claim 2, in which the accumulator controller includes an inlet port for connection to the fuel supply, one or more output ports in communication with the inlet port, a return port, and a solenoid-controlled valve, the solenoid-controlled valve disconnecting the return port from the inlet and injection ports when closed and connecting the return port to the inlet and injection ports when open.

4. The fuel injection system of claim 3, in which the fuel supply includes:

a fuel pump;

a common rail connected to the fuel pump;

a fuel line connecting the common rail to the inlet port; and a fuel line connecting the return port to a fuel supply return.

5. A fuel injection system, comprising:

a common rail for providing fuel at a fuel pressure;

an accumulation volume connected to the common rail;

a solenoid-controlled valve disposed to control the accumulation volume;

the solenoid-controlled valve having a first state for causing fuel to accumulate in the accumulation volume at the fuel pressure and a second state for spilling the fuel from the accumulation volume;

at least one accumulator injector separate from the accumulation volume and the solenoid-controlled valve; and a fuel line coupling the at least one accumulator injector to the accumulation volume.

6. The fuel injection system of claim 5, including two accumulator injectors and two fuel lines, each fuel line coupling a respective accumulator injector to the accumulation volume.

7. The fuel injection system of claim 5, further comprising a manifold containing the accumulation volume, the manifold including an inlet port in communication with the accumulation volume, one or more output ports in communication with the accumulation volume, and a return port, the solenoid controlled valve positioned in the manifold to disconnect the return port from the accumulation volume when closed and to connect the return port to the accumulation volume when open.

8. A fuel injection system, comprising:

a common rail for providing fuel at a fuel pressure;

at least one accumulator injector;

a fuel line connected to the accumulator injector;

an accumulator controller connected to the common rail and the fuel line;

the accumulator controller having a first state for feeding fuel into the fuel line at a first pressure that charges the at least one accumulator injector and a second state for returning fuel from the fuel line at a second pressure that is lower than the first pressure and initiates injection by the at least one accumulator injector.

9. The fuel injection system of claim 8, in which the accumulator controller includes an inlet port for connection to the common rail, one or more output ports in communication with the inlet port, a return port, and a solenoid-controlled valve, the solenoid-controlled valve disconnecting the return port from the inlet and injection ports when closed and connecting the return port to the inlet and injection ports when open.

10. The fuel injection system of claim 9, further including:

a fuel pump connected to the common rail;

a fuel line connecting the common rail to the inlet port; and a fuel line connecting the return port to a fuel supply return.

11. The fuel injection system of claim 8, in which the accumulator controller comprises:

a manifold;

a solenoid-controlled valve received in the manifold;
an accumulation volume defined in the manifold;
an inlet port on the manifold in communication with the accumulation volume;
one or more outlet ports on the manifold in communication with the accumulation volume; and
a return port on the manifold;
the solenoid-controlled valve disconnecting the return port from the accumulation volume when closed and connecting the return port to the accumulation volume when open.

12. An internal combustion engine, comprising:
a plurality of cylinders;
an engine control unit;
a fuel supply; and
for each cylinder:
at least one accumulator injector communicating with the cylinder;
a fuel line connected to the accumulator injector;
an accumulator controller connected to the fuel supply, to the fuel line, and to the engine control unit;
the accumulator controller responsive to the engine control unit for assuming a first state to feed fuel into the fuel line at a first pressure that charges the at least one accumulator injector and for assuming a second state to return fuel from the fuel line at a second pressure that is lower than the first pressure and initiates injection by the at least one accumulator injector.

13. The internal combustion engine of claim 12, in which the accumulator controller includes an inlet port for connection to the fuel supply, one or more outlet ports in communication with the inlet port, a return port, and a solenoid-controlled valve connected to the engine control unit, the solenoid controlled valve disconnecting the return port from the inlet and outlet ports when closed and connecting the return port to the inlet and outlet ports when open.

14. The internal combustion engine of claim 13, in which the fuel supply includes:
a fuel pump;
a common rail coupled to the fuel pump; and
for each accumulator controller, a fuel line connecting the common rail to the inlet port, and a fuel line connecting the return port to a fuel supply return.

15. An internal combustion engine, comprising:
a plurality of cylinders;
an engine control unit;
a common rail for providing fuel at a fuel pressure; and
for each cylinder:
an accumulation volume coupled to the common rail;
a solenoid-controlled valve connected to the engine control unit and disposed to control the accumulation volume;
the solenoid-controlled valve responsive to a signal produced by the engine control unit for assuming a first state for causing fuel to accumulate in the accumulation volume at the fuel pressure or a second state for spilling the fuel from the accumulation volume;
at least one accumulator injector separate from the accumulation volume and the solenoid-controlled valve;
a fuel line connecting the at least one accumulator injector to the accumulation volume.

16. The engine of claim 15, including, for each cylinder, two accumulator injectors and two fuel lines, each fuel line coupling a respective accumulator injector to an accumulation volume.

17. The engine of claim 16, further comprising, for each cylinder, a manifold containing an accumulation volume, the manifold including an inlet port in communication with the accumulation volume, one or more output ports in communication with the accumulation volume, and a return port, the solenoid controlled valve positioned in the manifold to disconnect the return port from the accumulation volume when closed and to connect the return port to the accumulation volume when open.

18. An internal combustion engine, comprising:
a plurality of cylinders;
an engine control unit;
a common rail for providing fuel at a fuel pressure;
for each cylinder:
at least one accumulator injector;
a fuel line connected to the accumulator injector;
an accumulator controller connected to the engine control unit, the common rail and the fuel line;
the accumulator controller responsive to a signal produced by the engine control unit for assuming a first state to feed fuel into the fuel line at a first pressure that charges the at least one accumulator injector or a second state to return fuel from the fuel line at a second pressure that is lower than the first pressure and initiates injection by the at least one accumulator injector.

19. The engine of claim 18, in which each accumulator controller includes an inlet port for connection to the common rail, one or more output ports in communication with the inlet port, a return port, and a solenoid-controlled valve, the solenoid-controlled valve disconnecting the return port from the inlet and injection ports when closed and connecting the return port to the inlet and injection ports when open.

20. The engine of claim 19, further including:
a fuel pump connected to the common rail; and
for each accumulator controller:
a fuel line connecting the common rail to the inlet port of the accumulator controller; and
a fuel line connecting the return port of the accumulator controller to a fuel supply return.

* * * * *